US008130103B2

(12) United States Patent
Huang et al.

(10) Patent No.: US 8,130,103 B2
(45) Date of Patent: Mar. 6, 2012

(54) METHOD OF REDUCING POWER CONSUMPTION OF A RADIO BADGE IN A BOUNDARY DETECTION LOCALIZATION SYSTEM

(75) Inventors: Polly Huang, Taipei (TW); Tsung-Han Lin, Taipei (TW); Hao-Hua Chu, Taipei (TW)

(73) Assignee: National Taiwan University (TW)

( * ) Notice: Subject to any disclaimer, the term of this patent is extended or adjusted under 35 U.S.C. 154(b) by 381 days.

(21) Appl. No.: 12/427,908

(22) Filed: Apr. 22, 2009

(65) Prior Publication Data

US 2010/0134288 A1 Jun. 3, 2010

(30) Foreign Application Priority Data

Dec. 2, 2008 (TW) ..... 97146751 A

(51) Int. Cl.
*G08B 13/14* (2006.01)

(52) U.S. Cl. ..... 340/572.4; 340/10.1; 340/10.2; 340/10.3; 340/10.4; 340/10.5; 340/572.1; 340/572.2; 340/572.3; 340/572.5; 340/572.6; 235/375; 235/376; 235/377; 235/378; 455/456.1; 455/456.2; 455/456.3; 455/456.4; 455/456.6

(58) Field of Classification Search .... 340/572.1–572.9, 340/10.1–10.5; 235/375–385; 455/456.1–456.6
See application file for complete search history.

(56) References Cited

U.S. PATENT DOCUMENTS

2007/0247316 A1* 10/2007 Wildman et al. ..... 340/572.4
2009/0075678 A1* 3/2009 Ogoro ..... 455/456.6

* cited by examiner

*Primary Examiner* — George Bugg
*Assistant Examiner* — Ojiako Nwugo
(74) *Attorney, Agent, or Firm* — Baker & McKenzie LLP

(57) ABSTRACT

A method of reducing power consumption of a radio badge in a boundary detection localization system is disclosed, in which the radio badge is carried by a tracked target and performs location sampling communication with an infrastructure component of the localization system at the start and end of sampling time intervals such that positions of the radio badge can be estimated. The method includes: determining a velocity of the radio badge; estimating a critical time for the radio badge to reach a critical region through division in which a critical distance from an estimated position obtained at the end of a most recent sampling time interval to the critical region is the dividend, and the velocity of the radio badge is the divisor; and controlling the radio badge to perform location sampling communication with the infrastructure component of the localization system at the end of the critical time.

18 Claims, 3 Drawing Sheets

METHOD OF REDUCING POWER CONSUMPTION OF A RADIO BADGE IN A BOUNDARY DETECTION LOCALIZATION SYSTEM

CROSS-REFERENCE TO RELATED APPLICATION

This application claims priority of Taiwanese Application No. 097146751, filed on Dec. 2, 2008.

BACKGROUND OF THE INVENTION

1. Field of the Invention

The present invention relates to an indoor localization method, more particularly to a method of reducing power consumption of a radio badge in a boundary detection localization system.

2. Description of the Related Art

Sensor network technologies have undergone significant advances in recent times. This has enabled a variety of applications in consumer electronics. For example, sensor networks are increasingly being used for asset tracking in warehouses, patient monitoring in medical facilities, using location to infer activities of daily living (ADL) at home, and other such object-tracking applications.

One class of localization technology aims at detecting the crossing of boundaries. For example, boundary detection localization may be used for detection of troop movement, such as by detecting whether enemy troops have crossed a national borderline, for theft control, such as by detecting the exiting of products from a store, or for child safety, such as by detecting whether a young child has entered a balcony area.

Early detection is essential for boundary detection services. That is, users of such technology desire to be notified of boundary crossing events before a tracked target goes too far into a critical region. One way to ensure early detection is frequent sampling via a high sampling rate that is fixed, where the sampling rate is defined as the rate at which an infrastructure component of the localization system and mobile units thereof are triggered to perform communication and computation. However, the energy consumption of the mobile units, which are attached to or carried by tracked targets and are typically small battery-powered tags or radio badges, is directly proportional to the sampling rate.

The problem with fixed-rate sampling is that while the sampling rate can be set high to provide real-time location information, when the target is far from the critical region where the requirement for timely service is not as high, a high sampling rate and the high power requirements associated therewith will be unnecessary. This is particularly problematic for the mobile units.

SUMMARY OF THE INVENTION

Therefore, the object of the present invention is to provide a method of reducing power consumption of a radio badge in a boundary detection localization system, in which the radio badge is carried by a tracked target, performs location sampling communication with an infrastructure component of the localization system at the start and end of sampling time intervals such that positions of the radio badge can be estimated, and is provided with an accelerometer.

According to a first aspect of this invention, the method comprises: determining a velocity of the radio badge; estimating a critical time for the radio badge to reach a critical region through division in which a critical distance from an estimated position obtained at the end of a most recent sampling time interval to the critical region is the dividend, and the velocity of the radio badge is the divisor; and controlling the radio badge to perform location sampling communication with the infrastructure component of the localization system at the end of the critical time.

According to a second aspect of this invention, the method comprises: determining a velocity of the radio badge if it is determined from an output of the accelerometer that the radio badge is in a mobile state; estimating a critical time for the radio badge to reach a critical region through division in which a critical distance from an estimated position obtained at the end of a most recent sampling time interval to the critical region is the dividend, and the velocity of the radio badge is the divisor; and controlling the radio badge to perform location sampling communication with the infrastructure component of the localization system at the end of the critical time.

According to a third aspect of this invention, the method comprises: determining a velocity of the radio badge; estimating a critical time for the radio badge to reach a critical region through division in which a critical distance from an estimated position obtained at the end of a most recent sampling time interval to the critical region is the dividend, and the velocity of the radio badge is the divisor; and controlling the radio badge to perform location sampling communication with the infrastructure component of the localization system at one of the end of a preset extended time interval if the estimated critical time is greater than a predetermined upper bound, the end of a preset shortened time interval shorter than the extended time interval if the estimated critical time is less than a predetermined lower bound, and the end of the estimated critical time if the estimated critical time falls between or on the upper and lower bounds.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

A method of reducing power consumption of a radio badge in a boundary detection localization system according to a preferred embodiment of the present invention is used to detect whether a tracked target carrying a radio badge has reached a boundary of a critical region. The radio badge performs location sampling communication with an infrastructure component of the boundary detection localization system in order to estimate positions of the radio badge.

In greater detail, the boundary detection localization system is radio frequency-based, and is composed of an infrastructure component and a mobile component. The infrastructure component includes a positioning engine, and beacon nodes installed on, for example, the ceiling of a deployed environment. These beacon nodes use radio to periodically broadcast beacon packets containing their beacon IDs. The mobile component includes the radio badge carried by the tracked target. The radio badge acquires a record of the receiving power of beacon packets, and a sensor network infrastructure relays this record, pairs of beacon IDs, and signal strength (SS) back to the positioning engine of the infrastructure component. Once the positioning engine collects enough SS information from the radio badge, it estimates the current position of the radio badge. The radio badge may be provided with an accelerometer in some implementations.

Figure 1:
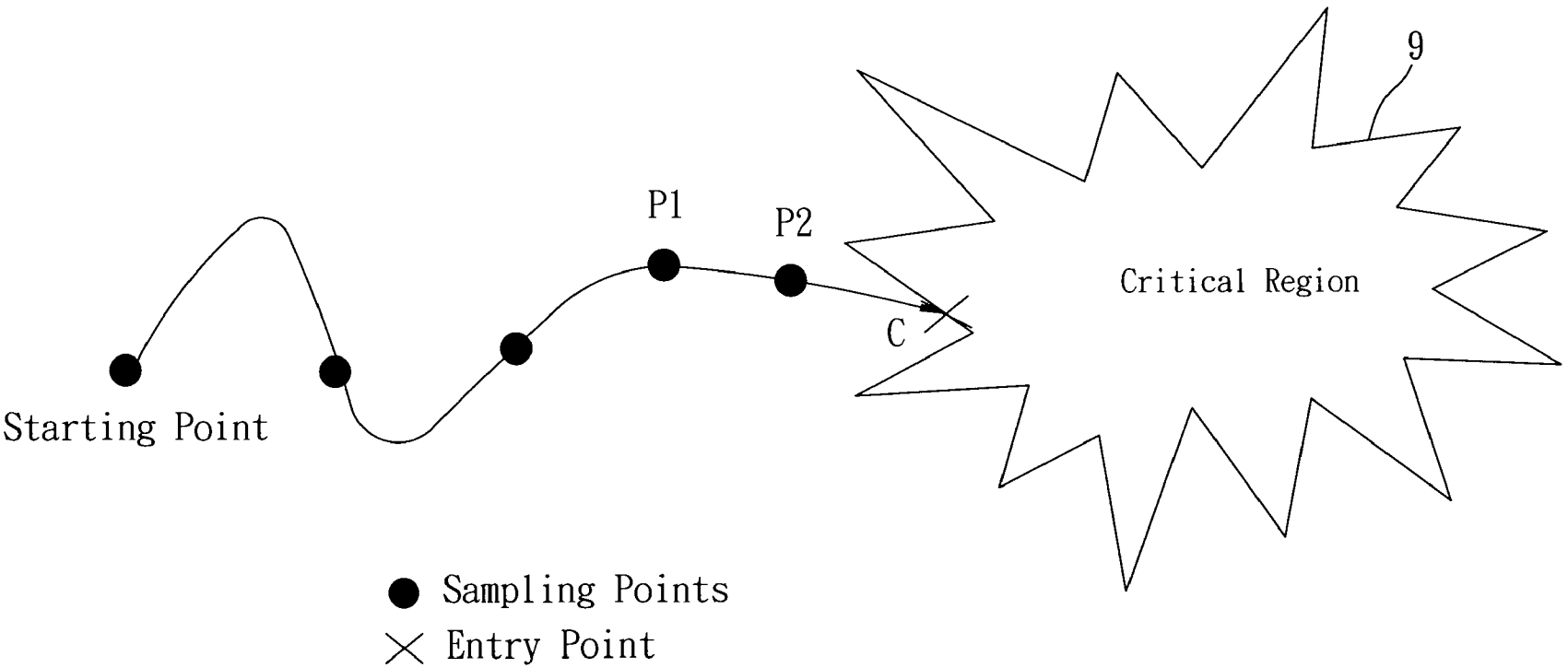
FIG. 1 is a schematic diagram, illustrating an example of how a target is tracked along a path toward a critical region.

Referring to FIG. 1, given a critical region 9 of interest for a particular application, the method according to the present invention controls the rate at which the boundary detection localization system is triggered to acquire location information, and in particular, the rate at which the radio badge performs location sampling communication with the infrastructure component of the boundary detection localization system. When the tracked target (and hence the radio badge carried by the tracked target) moves close to the critical region 9, the sampling rate increases to enable accurate detection of the tracked target entering the critical region 9. When the tracked target moves away from the critical region 9, the sampling rate decreases to conserve power. Moreover, through use of the accelerometer provided on or in the radio badge, the radio badge is controlled to perform location sampling communication with the infrastructure component of the boundary detection localization system only when it is determined that the radio badge is in a mobile state so as to further conserve power of the radio badge.

It is assumed in the method of this invention that the tracked target moves at a constant velocity between two position readings. Hence, in the preferred embodiment, two position samples are used for estimation of velocity. As shown in FIG. 1, ($P_1$) and ($P_2$) are the two most recent sampling points, i.e., the start and end of a most recent sampling time interval. The velocity (V) between ($P_1$) and ($P_2$) can be calculated to be the distance between ($P_1$) and ($P_2$) divided by the corresponding time interval ($t_2$)-($t_1$), as shown in Equation (1) below:

$$V = \frac{|\vec{P}_2 - \vec{P}_1|}{t_2 - t_1} \quad (1)$$

A critical point (C) is where the line of movement of the tracked target intersects the critical region 9. When the tracked target reaches the position ($P_2$), the method of this invention sets the time for the next sample (i.e., the time at which the radio badge performs location sampling communication with the infrastructure component) by calculating a time (referred to hereinafter as a "critical time") needed for the tracked target to move from the current position ($P_2$) to the critical point (C) at the velocity (V). Denoting a distance between ($P_2$) and (C) as (D) (referred to hereinafter as a "critical distance"), the critical time (T) for the tracked target to reach the critical point (C) can be estimated using Equation (2) below:

$$T=D/V \quad (2)$$

To avoid drastic error resulting from a rough estimation of velocity or from an extremely low estimation of velocity, the maximum value of the critical time (T) is bounded in the present invention by a preset upper bound. This upper bound limits the error of detecting the tracked target crossing the boundary of the critical region 9. For example, if the velocity (V) of the radio badge is determined to be extremely low, the critical time (T) estimated using Equation (2) will be exceedingly large. However, if the tracked target subsequently moves more quickly or more directly toward the critical region 9, the estimated critical time (T) will not be accurate. To prevent such errors, the upper limit of the critical time (T) is set to be equal to the upper bound.

It is noted that the smaller the upper bound, the greater the likelihood that the boundary detection localization system will be triggered to localize the tracked target at the critical point (C). However, a smaller upper bound will also result in a reduced amount of energy conservation.

In practice, indoor localization systems report tracked target positions with errors. If two recent reports are taken within a very short period of time, the physical change of the position of the tracked target will be small relative to the localization error. In other words, the velocity prediction will be dominated by the location estimation error. As a result, more frequent sampling will not help improve the accuracy in detecting boundary crossing events. Setting a lower bound avoids such ineffective use of energy.

Figure 3:
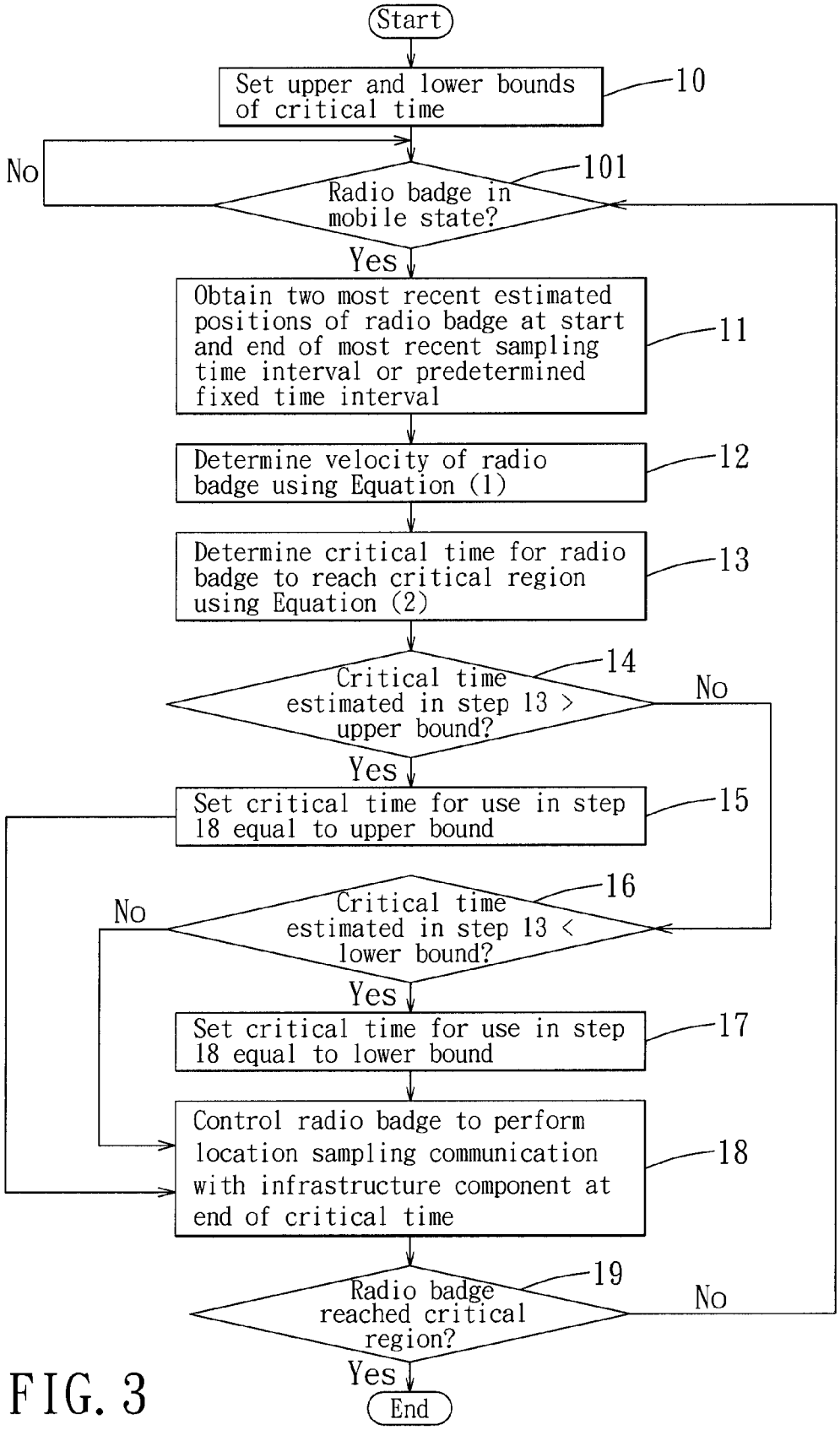
FIG. 3 is a flow chart of a method of reducing power consumption of a radio badge in a boundary detection localization system according to a preferred embodiment of the present invention.

The method of reducing power consumption of a radio badge in a boundary detection localization system according to the preferred embodiment of the present invention will now be described with reference to FIGS. 1 and 3.

First, in step 10, the upper and lower bounds of the critical time (T) are set. In the preferred embodiment, the upper bound is set to be 3.5 seconds and the lower bound is set to be 1 second. In some embodiments, the upper and lower bounds are preset, for example, as values stored in a non-volatile memory of the radio badge and/or the infrastructure component.

Next, in step 101, it is determined from an output of the accelerometer mounted on or in the radio badge whether the radio badge is in a mobile state (i.e., non-zero speed).If it is determined that the radio badge is not in a mobile state, subsequent steps of the method are not performed, and instead, step 101 is repeated until a mobile state of the radio badge is detected.

If, on the other hand, it is determined that the radio badge is in a mobile state in step 101, then in step 11, two most recent estimated positions of the radio badge are obtained at the start and end of the most recent sampling time interval. In step 11, if the location sampling communication is conducted for the first time between the radio badge and the infrastructure component of the boundary detection localization system, the most recent sampling time interval is set to be equal to a predetermined fixed time interval. In one embodiment, the predetermined fixed time interval is 2 seconds. To provide an example, when the predetermined fixed time interval is used, the first estimated position of the radio badge may be obtained immediately after the radio badge is turned on, and the second estimated position of the radio badge may be obtained at the end of the predetermined fixed time interval.

Next, in step 12, the velocity (V) of the radio badge is determined. In the preferred embodiment, the velocity (V) of the radio badge is determined using Equation (1) that is, through division in which a distance between the two most recent estimated positions of the radio badge, which are obtained at the start and end of the most recent sampling time interval, is the dividend, and the most recent sampling time interval is the divisor. Next, in step 13, the critical time (T) for the radio badge to reach the critical region 9 is estimated. In the preferred embodiment, the critical time (T) is estimated using Equation (2), that is, through division in which the critical distance (D) from the estimated position obtained at the end of the most recent sampling time interval to the critical region 9 is the dividend, and the velocity (V) of the radio badge is the divisor.

Next, in step 14, it is determined whether the critical time (T) estimated in step 13 is greater than the upper bound.

If the critical time (T) estimated in step 13 is greater than the upper bound, which indicates that the critical time (T) calculated using Equations (1) and (2) is too large, then in step 15, the critical time (T) used for controlling the radio badge in a subsequent step (i.e., step 18) is set to be equal to the upper bound, which is 3.5 seconds in the preferred embodiment. Next, in step 18, the radio badge is controlled to perform location sampling communication with the infrastructure component of the boundary detection localization system at the end of the critical time (T)

Subsequently, in step 19, it is determined whether the radio badge has reached the critical region 9. If the radio badge has reached critical region 9, the flow is terminated. Otherwise, the flow goes back to step 101.

In step 14, if it is determined that the critical time (T) estimated in step 13 is not greater than the upper bound, then in step 16, it is determined whether the critical time (T) estimated in step 13 is less than the lower bound.

If the critical time (T) estimated in step 13 is less than the lower bound, which indicates that the critical time (T) calculated using Equations (1) and (2) is too small, then in step 17, the critical time (T) used for controlling the radio badge in step 18 is set to be equal to the lower bound, which is 1 second in the preferred embodiment. After step 17, step 18 is performed using the lower bound as the critical time (T), after which step 19 is performed as described above.

Moreover, if it is determined in step 14 that the critical time (T) estimated in step 13 is not greater than the upper bound, and in step 16 that the critical time (T) estimated in step 13 is not smaller than the lower bound, this indicates that the critical time (T) estimated in step 13 using Equations (1) and (2) falls between or on the upper and lower bounds of the critical time (T), and hence may be used directly in step 18. That is, in this case, the radio badge is controlled to perform location sampling communication with the infrastructure component of the boundary detection localization system at the end of the critical time (T) estimated in step 13, after which step 19 is performed as described above.

In some embodiments, the radio badge is controlled to perform location sampling communication with the infrastructure component of the boundary detection localization system at one of the following: the end of a preset extended time interval if the estimated critical time (T) is greater than the predetermined upper bound; the end of a preset shortened time interval shorter than the extended time interval if the estimated critical time (T) is less than the predetermined lower bound; and the end of the estimated critical time (T) if the estimated critical time (T) falls between or on the upper and lower bounds. In such alternative embodiments, the preset extended and shortened time intervals may be different from the upper and lower bounds.

Figure 2:
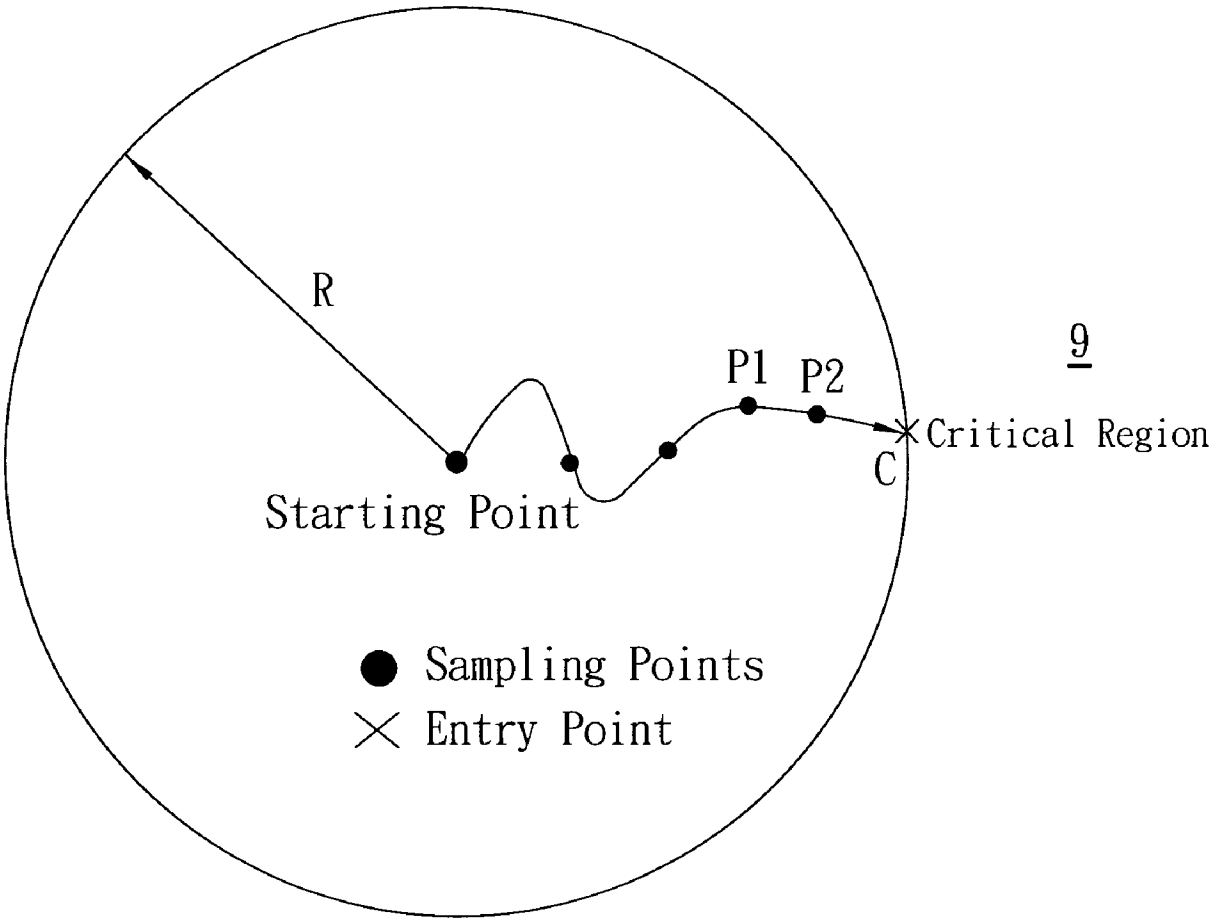
FIG. 2 is a schematic diagram, illustrating another example of how a target is tracked along a path toward a critical region, in which the critical region is simplified for computer-simulation purposes.

To evaluate the method of the present invention, the applicants performed a computer simulation. Referring to FIG. 2, to simplify the setting for the computer simulation, the critical region 9 is formed in a regular shape, in which the region more than a distance (R) away from the starting point is set as the critical region 9, and the critical points (C), also referred to as entry points (X), form a circle centered at the starting point and delineate the start of the critical region 9.

Two efficiency measurements were used in the computer simulation, namely, estimation accuracy and average location sampling rate. Estimation accuracy refers to how close the radio badge is to the critical region 9 at the end of an estimation period. In the case of the present invention, estimation accuracy refers to how close the radio badge is to the critical region 9 at the end of the critical time (T), which may be set to be equal to the upper bound or the lower bound as described above.

Average location sampling rate is now explained. The total power consumption of the boundary detection localization system is not, of course, actually measured in the computer simulation. In practice, the amount of energy required to localize a tracked target depends upon the design of the system and hence varies from system to system. In the simulation, it is assumed that, for a given boundary detection localization system, power consumption for each localization is fixed. It is also assumed that a small number of nodes equipped with RF transceivers have been disposed in the simulation area, and that the tracked target is equipped with a corresponding transceiver (i.e., the radio badge) to receive RF signals, and based on the RF signals, Equations (1) and (2) may be used to calculate the velocity (V) of the tracked target and the next sampling time.

Since the RF interface is the primary energy consumer, the number of localization samples is directly proportional to the power consumption of the mobile units. Hence, in the simulation, the average location sampling rate was measured to evaluate the power efficiency of the method of the present invention. A lower average sampling rate is indicative of better energy efficiency. The results of the computer simulation show that, in comparison with conventional boundary detection localization methods utilizing a fixed sampling rate, the method of reducing power consumption of a radio badge in a boundary detection localization system of this invention realizes a higher estimation accuracy and a lower average positioning sampling rate (i.e., lower power consumption).

The applicants also conducted a field test for further evaluation of the method of the present invention. The field test was performed by setting up a Zigbee-based localization system to verify the simulation results. An RSSI (Radio Signal Strength Indicator)-signature-based approach was adopted to estimate locations. The idea of a signature map is to exploit the mapping between a location of a tag (or radio badge) and the RSSI from a set of pre-deployed beacons, referred to as the RSSI vector. The tracking area is surveyed to construct a reference RSSI signature for each sampled location. Using the signature map, the localization system compares the RSSI vectors collected in the tracking phase to the reference RSSI signatures to identify the closest possible location. In the field test, a k-nearest-neighbor (KNN) method was used for signature comparison, in which the applicants selected the top k sample locations whose RSSI signatures were the closest to the collected RSSI vector. AKNN estimator is able to output a location as an average of the top k locations' coordinates weighted by the Euclidean distances between the RSSI vector and the signature. The location from the KNN estimator is later processed by particle filters, which are nonlinear filters that incorporate human mobility models to improve localization accuracy. In operation, the radio badge will turn its radio interface on to collect RSSI vectors so as to obtain an estimated location from the positioning engine.

For the field test, the localization system included 14 beacons deployed 6 meters apart on the ceiling. These beacons served as beacon nodes which periodically broadcasted messages containing RSSI values at an interval of 200 ms. On the user side, the tracked target wore a radio badge for localization and movement detection. The beacons and the radio badges used the same 2.4 GHz Zigbee radio interface, and therefore were able to exchange RF messages.

Moreover, in the field test, the applicants set the critical region 9 as a vertical line along the middle of a corridor to test the sensitivity of the sampling mechanism. In the field test, as in the case of the computer simulation above, the same parameter set values were used for the upper and lower bounds, that is, an upper bound of 3.5 seconds and a lower bound of 1 second, and the predetermined fixed time interval was set as 2 seconds. The results of the field test show that, in comparison with conventional boundary detection localization methods utilizing a fixed sampling rate, the method of the present invention realizes a higher estimation accuracy and a lower average positioning sampling rate.

The accelerometer used in step 101 (see FIG. 3) of the method of this invention may be, for instance, an ADXL 202 2-axis accelerometer or an ADXL 330 3-axis accelerometer available from Analog Devices Incorporated. However, this invention is not limited in this regard, and any accelerometer capable of performing the operation associated with step 101 may be used.

In the method of reducing power consumption of a radio badge in a boundary detection localization system of the present invention, the velocity (V) of the radio badge is determined based on the distance between two most recent estimated positions of the radio badge, and the critical time (T) for the radio badge to reach the critical region 9 is estimated using the calculated velocity (V) and the critical distance (D). In some embodiments, the method of this invention also determines whether the radio badge is in a mobile state, and the radio badge is controlled to perform location sampling communication with the infrastructure component of the localization system only when the radio badge is in a mobile state. Hence, as evidenced by the computer simulation and field test, in comparison with conventional boundary detection localization methods which employ fixed sampling rates, the present invention results in higher estimation accuracy, as well as a lower average positioning sampling rate, and hence, a lower power consumption.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method of reducing power consumption of a radio badge in a boundary detection localization system, the radio badge being carried by a tracked target and performing location sampling communication with an infrastructure component of the localization system at the start and end of sampling time intervals such that positions of the radio badge can be estimated, said method comprising:

(a) determining a velocity of the radio;

(b) estimating a critical time for the radio badge to reach a critical region through division in which a critical distance from an estimated position obtained at the end of a most recent sampling time interval to the critical region is the dividend, and the velocity of the radio badge is the divisor; and (c) controlling the radio badge to perform location sampling communication with the infrastructure component of the localization system at the end of the critical time;

wherein if the estimated critical time in step (b) is greater than a preset upper bound, the critical time used in step (c) is set to be equal to the upper bound, and if the estimated critical time in step (b) is less than a preset lower bound, the critical time used in step (c) is set to be equal to the lower bound.

2. The method of claim 1, wherein the upper bound is 3.5 seconds and the lower bound is 1 second.

3. The method of claim 1, wherein steps (a) to (c) are repeated if it is determined after step (c) that the radio badge has not reached the critical region.

4. The method of claim 1, wherein, in step (a), the velocity of the radio badge is determined through division in which a distance between two most recent estimated positions of the radio badge, which are obtained at the start and end of the most recent sampling time interval, is the dividend, and the most recent sampling time interval is the divisor.

5. The method of claim 4, wherein, in step (a), the most recent sampling time interval is set to be equal to a predetermined fixed time interval if the location sampling communication is conducted for the first time between the radio badge and the infrastructure component of the localization system.

6. The method of claim 5, wherein the predetermined fixed time interval is 2 seconds.

7. A method of reducing power consumption of a radio badge in a boundary detection localization system, the radio badge being carried by a tracked target, performing location sampling communication with an infrastructure component of the localization system at the start and end of sampling time intervals such that positions of the radio badge can be estimated, and being provided with an accelerometer, said method comprising:

(a) determining a velocity of the radio badge if it is determined from an output of the accelerometer that the radio badge is in a mobile state;

(b) estimating a critical time for the radio badge to reach a critical region through division in which a critical distance from an estimated position obtained at the end of a most recent sampling time interval to the critical region is the dividend, and the velocity of the radio badge is the divisor; and (c) controlling the radio badge to perform location sampling communication with the infrastructure component of the localization system at the end of the critical time;

wherein if the estimated critical time in step (b) is greater than a preset upper bound, the critical time used in step (c) is set to be equal to the upper bound, and if the estimated critical time in step (b) is less than a preset lower bound, the critical time used in step (c) is set to be equal to the lower bound.

8. The method of claim 7, wherein the upper bound is 3.5 seconds and the lower bound is 1 second.

9. The method of claim 7, wherein steps (a) to (c) are repeated if it is determined after step (c) that the radio badge has not reached the critical region.

10. The method of claim 7, wherein, in step (a), the velocity of the radio badge is determined through division in which a distance between two most recent estimated positions of the radio badge, which are obtained at the start and end of the most recent sampling time interval, is the dividend, and the most recent sampling time interval is the divisor.

11. The method of claim 10, wherein, in step (a), the most recent sampling time interval is set to be equal to a predetermined fixed time interval if the location sampling communication is conducted for the first time between the radio badge and the infrastructure component of the localization system.

12. The method of claim 11, wherein the predetermined fixed time interval is 2 seconds.

13. A method of reducing power consumption of a radio badge in a boundary detection localization system, the radio badge being carried by a tracked target and performing location sampling communication with an infrastructure component of the localization system at the start and end of sampling time intervals such that positions of the radio badge can be estimated, said method comprising:

(a) determining a velocity of the radio badge;

(b) estimating a critical time for the radio badge to reach a critical region through division in which a critical distance from an estimated position obtained at the end of a most recent sampling time interval to the critical region is the dividend, and the velocity of the radio badge is the divisor; and (c) controlling the radio badge to perform location sampling communication with the infrastructure component of the localization system at one of the end of a preset extended time interval if the estimated critical time is greater than a predetermined upper bound, the end of a preset shortened time interval shorter than the extended time interval if the estimated critical time is less than a predetermined lower bound, and the end of the estimated critical time if the estimated critical time falls between or on the upper and lower bounds.

14. The method of claim 13, wherein steps (a) to (c) are repeated if it is determined after step (c) that the radio badge has not reached the critical region.

15. The method of claim 13, wherein, in step (a), the velocity of the radio badge is determined through division in which a distance between two most recent estimated positions of the radio badge, which are obtained at the start and end of the most recent sampling time interval, is the dividend, and the most recent sampling time interval is the divisor.

16. The method of claim 15, wherein, in step (a), the most recent sampling time interval is set to be equal to a predetermined fixed time interval if the location sampling communication is conducted for the first time between the radio badge and the infrastructure component of the localization system.

17. The method of claim 16, wherein the predetermined fixed time interval is 2 seconds.

18. The method of claim 13, the radio badge being provided with an accelerometer, wherein step (a) is performed if it is determined from an output of the accelerometer that the radio badge is in a mobile state.

* * * * *